US010512381B2

(12) United States Patent
Meggle et al.

(10) Patent No.: US 10,512,381 B2
(45) Date of Patent: Dec. 24, 2019

(54) SYSTEM COMPRISING A VACUUM CLEANER AND A BASE STATION, VACUUM CLEANER, BASE STATION, AND METHOD FOR EMPTYING A DUST CHAMBER OF A VACUUM CLEANER

(71) Applicant: Vorwerk & Co. Interholding GmbH, Wuppertal (DE)

(72) Inventors: Martin Meggle, Herzebrock (DE); Miron Sernecki, Hagen (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 291 days.

(21) Appl. No.: 15/558,638

(22) PCT Filed: Mar. 14, 2016

(86) PCT No.: PCT/EP2016/055387
§ 371 (c)(1),
(2) Date: Sep. 15, 2017

(87) PCT Pub. No.: WO2016/146555
PCT Pub. Date: Sep. 22, 2016

(65) Prior Publication Data

US 2018/0064303 A1 Mar. 8, 2018

(30) Foreign Application Priority Data

Mar. 16, 2015 (DE) ..... 10 2015 103 825

(51) Int. Cl.
*A47L 9/20* (2006.01)
*A47L 9/28* (2006.01)
(Continued)

(52) U.S. Cl.
CPC ..... *A47L 9/2873* (2013.01); *A47L 9/12* (2013.01); *A47L 9/1409* (2013.01); *A47L 9/149* (2013.01); *A47L 9/20* (2013.01); *A47L 2201/024* (2013.01)

(58) Field of Classification Search
CPC ..... A47L 9/2873; A47L 9/20; A47L 9/149; A47L 9/1409; A47L 9/12; A47L 9/106; A47L 2201/024
(Continued)

(56) References Cited

U.S. PATENT DOCUMENTS

2005/0011036 A1 1/2005 McCutchen

FOREIGN PATENT DOCUMENTS

DE 195 17 197 A 11/1996
DE 103 21 977 A1 12/2004
(Continued)

OTHER PUBLICATIONS

International Search Report of PCT/EP2016/055387, dated Jun. 21, 2016.

*Primary Examiner* — David Redding
(74) *Attorney, Agent, or Firm* — Collard & Roe, P.C.

(57) ABSTRACT

A system comprising a vacuum cleaner and a base station, wherein the vacuum cleaner has a suction opening for sucking up dirt and/or dust from a floor by a suction air flow, a fan for producing the suction air flow, a dust chamber for holding dirt and/or dust, and an air outlet opening such that air sucked in together with the dirt and/or dust can be discharged again. The base station can be connected to the vacuum cleaner in such a way that the dust chamber can be emptied into the base station by means of an air flow. The air flow used to empty the dust chamber can be produced and blown into the dust chamber by the fan for producing the suction air flow. The base station has a return channel,
(Continued)

through which the air flow exiting the dust chamber can be guided back into the vacuum cleaner.

16 Claims, 7 Drawing Sheets

(51) Int. Cl.
*A47L 9/12* (2006.01)
*A47L 9/14* (2006.01)

(58) Field of Classification Search
USPC ..... 15/339, 352
See application file for complete search history.

(56) References Cited

FOREIGN PATENT DOCUMENTS

| | | | |
|---|---|---|---|
| DE | 10 2008 011 723 | A1 | 9/2009 |
| DE | 10 2008 030 707 | A1 | 12/2009 |
| DE | 10 2009 041 728 | A1 | 6/2010 |
| DE | 10 2010 017 213 | A1 | 12/2011 |
| WO | 2004/100748 | A1 | 11/2004 |

SYSTEM COMPRISING A VACUUM CLEANER AND A BASE STATION, VACUUM CLEANER, BASE STATION, AND METHOD FOR EMPTYING A DUST CHAMBER OF A VACUUM CLEANER

CROSS REFERENCE TO RELATED APPLICATIONS

This application is the National Stage of PCT/EP2016/055387 filed on Mar. 14, 2016, which claims priority under 35 U.S.C. § 119 of German Application No. 10 2015 103 825.0 filed on Mar. 16, 2015, the disclosures of which are incorporated by reference. The international application under PCT article 21 (2) was not published in English.

The invention initially relates to a system comprising a vacuum cleaner and a base station, wherein the vacuum cleaner has a suction opening for sucking up dirt and/or dust from a floor by means of a suction air flow, a fan for producing the suction air flow, a dust chamber for holding dirt and/or dust, and an air outlet opening such that air sucked in together with the dirt and/or dust can be discharged again, and the base station can be connected to the vacuum cleaner in such a way that the dust chamber can be emptied into the base station by means of an air flow, wherein the air flow used to empty the dust chamber can be produced by the fan for producing the suction air flow and can be blown into the dust chamber, wherein the base station further has a return channel, through which the air flow exiting the dust chamber can be returned back into the vacuum cleaner or a return channel, through which the air flow exiting from the dust chamber can be returned back into the vacuum cleaner, is embodied in the base station for emptying the dust chamber.

The invention further relates to a vacuum cleaner comprising a suction opening for vacuuming a floor by means of a suction air flow, a fan for producing the suction air flow, a dust chamber comprising a filter for holding dirt and/or dust, wherein the filter has a clean side and a dust side, and an air outlet opening, such that air sucked in together with the dirt and/or dust can be discharged again.

The invention furthermore relates to a base station for connection to a vacuum cleaner for emptying a dust chamber in the vacuum cleaner, wherein the base station has two channels, a return channel and a suction channel, which are separated from one another.

The invention also relates to a method for emptying the dust chamber of a vacuum cleaner into a dust container of a base station, wherein the vacuum cleaner has a suction opening for absorbing dirt and/or dust from a floor by means of a suction air flow, a fan, by means of which the suction air flow is produced, a dust chamber for holding dirt and/or dust, and an air outlet opening such that air sucked in together with the dirt and/or dust can be discharged again, and the base station is connected to the vacuum cleaner in such a way that the dust chamber is emptied into the base station by means of an air flow, wherein the air flow used to empty the dust chamber is produced by the fan for producing the suction air flow and is blown into the dust chamber, and the air flow exiting from the dust chamber is returned through the base station back into the vacuum cleaner.

A system consisting of a vacuum cleaner and a base station, a vacuum cleaner and a base station alone as well as a method for emptying a vacuum cleaner by means of a base station is known from DE 10 2010 017 213 A1. With regard to the system, the opening, which is also used in the common suction operation, is used to empty the dust chamber of the vacuum cleaner, i.e. air is sucked in through the air outlet opening and air is blown out through the suction opening. The compressed air, which is produced in the base station or which is guided through the base station, must be blown into the suction opening in order to empty the dust chamber. The base station also has only one channel, through which the suction or compressed air is guided in the cleaning operation.

A system consisting of a vacuum cleaner and a base station is known from DE 10 2009 041 728 A1, in which the air flow used to empty the dust chamber must be produced by a fan of the base station. For this purpose, the vacuum cleaner has an additional blow-in opening, through which compressed air can be guided into the interior of the dust chamber in the cleaning operation, and through which the compressed air further conveys the dust into the base station as well. In addition to a return channel, the base station has a blow-out channel. Compressed air produced in the base station can only flow passively through the blow-in opening of the vacuum cleaner and the channel connected thereto. The air flow used to empty the dust chamber is produced outside of the vacuum cleaner. Only compressed air is applied to the dust chamber or a filter element, respectively. The suction opening and the air outlet opening of the vacuum cleaner are not used in the cleaning operation.

A self-cleaning vacuum cleaner is known from DE-A-195 17 197, to which purge air from a compressor is applied with regard to a filter element located therein in the cleaning operation. Dust released hereby remains in the vacuum cleaner and must be disposed of from there. A simple cleaning off of a ceramic filter by means of flow reversal is also known from DE 103 21 977 A1. A dust chamber, in which the dust is emptied in the cleaning off operation and can be removed mechanically from there, is hereby embodied on the suction side of the filter in the vacuum cleaner.

Based on the above-mentioned prior art, the invention deals with the object of specifying an advantageous system comprising a vacuum cleaner and a base station, an advantageous vacuum cleaner and an advantageous base station itself as well as an advantageous method for emptying a dust chamber of a vacuum cleaner.

With regard to the system this object is initially solved in that the vacuum cleaner has a suction opening, which is provided upstream of the fan in flow direction and which is in flow connection with the fan and can be used for the cleaning operation and in addition to the suction opening. Air can be sucked in from the outside via a further opening through this suction opening by means of the fan of the vacuum cleaner, and can be used advantageously for cleaning the dust chamber, if applicable for cleaning off a filter.

This object is also solved in that a suction channel is embodied in the base station in addition to the return channel comprising a suction opening, which is separated from the return channel and which can be connected to the suction opening, and a blowing opening, which can be connected for connection to the outlet opening. Due to the fact that blowing air as well as suction air can be guided in the base station, an advantageous connection to the vacuum cleaner can be attained in the cleaning operation.

With regard to the vacuum cleaner, the object is initially solved in that in addition to the suction opening or air outlet opening, two air suction openings, which can be opened, are embodied for a cleaning operation, in which dust collected in the vacuum cleaner is sucked up, one of which is switched to the suction side of the fan in the cleaning operation, to suck in air through this air suction opening by means of the fan. Air can be sucked in by means of the fan of the vacuum cleaner itself, through this further opening, the air suction opening, which can be opened, in addition to the suction opening and the air outlet opening, in the cleaning operation through the fan of the vacuum cleaner itself and can also be sucked into the vacuum cleaner through the further provided suction opening.

With regard to the base station, the solution of the object is geared towards the fact that both channels open with a respective suction and end opening in an outer surface of the base station, for connection to the vacuum cleaner. With this, the base station is in each case embodied for connection to corresponding openings of the vacuum cleaner with regard to the channels guided therein. In the connected state, flow can pass through the channels in a closed manner, without freely releasing air into the base station or suction freely out of the base station.

With regard to the method, it is significant that compressed air acts on a filter in the dust chamber in the cleaning operation on the clean side and suction air on the dust side, wherein the compressed air and the suction air are produced by the same fan and in each case act on the filter element by means of the base station via different lines or channels, respectively, which permeate the base station. A double application of the filter element is thus carried out, with compressed air as well as with suction air. The base station must be embodied in a suitable manner in order to introduce these air flows into the vacuum cleaner as suction air and as blowing air or compressed air, respectively, wherein the air flows can also be produced here by simply a fan of the vacuum cleaner.

By also using the fan, which is already provided in the vacuum clear for holding dirt and/or dust, to produce the air flow, by means of which the dust chamber is emptied into the base station, a base station without its own fan or a fan, which must be additionally attached, is made possible By returning the air flow, which exits from the dust chamber back into the vacuum cleaner, it is further made possible to carry out an emptying of the dust chamber and simultaneously the dust and/or dirt transport into the base station efficiently, whereby it is additionally made possible to avoid the escape of odors from the vacuum cleaner or the base station, respectively. According to the invention, it is also possible to avoid an interfering air flow being applied to the environment or flow noises transmitted by the air flow, respectively.

The air flow produced by means of the fan is used to empty the dust chamber, wherein the air flow with the deposits exits the dust chamber, preferably from the suction opening of the vacuum cleaner. The exiting air flow can then be guided into the dust container of the base station, so that the dirt and/or dust is transported from the vacuum cleaner into the base station. The air flow cleaned there is guided out of the dust container of the base station back into the vacuum cleaner and can be available to the fan again. A closed air flow circuit can thus be attained, wherein the air used to empty the dust chamber can be cleaned continuously through the filter, which is present in the base station.

The invention can be used advantageously for vacuum cleaners comprising permanent filters, which must be emptied after a certain time period and/or a predeterminable fill level of the dust chamber. These can in particular be hand-held or floor vacuum cleaners, but also robotic vacuum cleaners, which cooperate with a base station in order to empty the dust chamber. A base station does not necessarily need to be a stationary station, the base station can be designed so be stationary and fixed as well as as portable station.

A fan is included in the vacuum cleaner, wherein a suction operation can be made possible by means of the fan. An underpressure is produced by means of the fan, so that air can be sucked into the vacuum cleaner, whereby dirt and/or dust particles can be held, which are then filtered out of the sucked in air flow by means of the filter in the dust chamber. The filter is preferably arranged in the dust chamber, in the alternative, however, the filter can for example also be arranged directly upstream of the fan.

For emptying the dust chamber of the vacuum cleaner, the vacuum cleaner is coupled to the base station, wherein in the case of a hand-held vacuum cleaner, a coupling can for example be made by placing the hand-held vacuum cleaner into the base station. If, in contrast, the vacuum cleaner is a robotic vacuum cleaner, for example, the coupling can take place by moving the robotic vacuum cleaner into the base station or by moving against the base station, respectively.

A further embodiment of the invention follows, when the vacuum cleaner can be connected to the base station in such a way that the air flow can be introduced into the interior of the filter. The introduction of the air flow into the interior of the filter hereby does not only make it possible to empty the dust chamber, but to simultaneously also clean the filter. If the air flow produced by the fan is returned into the vacuum cleaner in such a way that the air flow reaches into the interior of the filter, it is made possible to blow out or clean off the filter, respectively, with respect to the filter. Blowing out hereby means that the air flow reaches from the interior of the filter through the filter into the dust chamber. The filter is blown out and cleaned, which, on the one hand, provides for an effective emptying and simultaneously prevents a contamination of the filter.

In a further embodiment, a rotating nozzle, in particular a slotted nozzle, can additionally be arranged in the interior of the filter, so that an intensified and directed air flow in the direction of the filter can be used and for cleaning off the filter. The rotational movement of the nozzle, which is arranged in the interior of the filter, is thereby attained by means of the air flow. The air flow produced by means of the fan can thereby first be introduced into the base station and can then be returned into the vacuum cleaner in such a way that the air flow is introduced into the filter on the fan side. In the alternative, the air flow can be introduced into the filter on the side opposite the fan. The filter can preferably be a cylindrical or conical filter, which extends axially. The nozzle, to which the air flow is applied, in the interior of the filter preferably has an axial extension, which makes it possible to apply an air flow on the inner circumference of the filter and beyond the entire extension.

Provision is preferably made for the air flow to be capable of being returned into the vacuum cleaner via valves, which can be controlled with the help of the air flow. An air flow, which flows into the base station after connecting the vacuum cleaner to the base station, is produced in an advantageous manner by means of the fan. The air flow can now be returned into the vacuum cleaner, wherein valves, which can be opened by means of the air flow, are arranged in the vacuum cleaner. The required number of electronic components in the base station is thus reduced. The air flow can independently provide for or support an opening of the valves, respectively. In addition, a fan is not required in the base station, so that the base station can be identified as passive base station.

The air flow returned into the vacuum cleaner can be used to empty the dust chamber, wherein the air flow flows out for example through the suction opening of the vacuum cleaner and empties the vacuum cleaner into the base station. The air flow flows back into the vacuum cleaner through the filter included in the base station, such as a filter bag, wherein only one valve is necessary, in turn, which can be controlled by means of an air flow. Such a setup reduces the number of the required electric or electronic components, respectively, in the base station as well as in the vacuum cleaner. The air returned into the vacuum cleaner can then in turn be returned into the fan again, so that a closed air circuit is made possible.

A further advantage results when the cleaning off of the filter and the emptying of the dust chamber are possible in a suction operation of the fan. A vacuum cleaner and in particular a vacuum cleaner, which is provided with a permanent filter, can be operated in suction operation. Suction operation hereby means that air is pulled into the vacuum cleaner, wherein the sucked-in air is cleaned via a filter, before it penetrates the fan. In vacuum cleaners, which are provided with permanent filters, it is known that the permanent filter is cleaned by switching the fan from a suction operation into a blowing operation. By means of the suitable air guide according to the invention in the base station, is it now possible to operate the vacuum cleaner only in suction operation—with regard to the operating mode of the fan. The filter is hereby cleaned in that the air flow produced by means of the fan is introduced into the base station and is returned back into the interior of the filter, so that a blowing operation can be realized in the vacuum cleaner with respect to the permanent filter. By switching over the air guide in the vacuum cleaner with the help of the combination of vacuum cleaner and base station, a functional expansion is thus attained, without requiring an additional adaptation of electric or electronic components.

In an embodiment of the invention, the air flow can be introduced into the dust chamber through the filter and the air flow guided through the filter simultaneously serves to clean off the dust chamber. If the air flow produced by the fan is guided through the filter, a cleaning off of the filter can take place immediately. If the filter is now arranged in the dust chamber in such a way that the air flow exiting from the filter reaches directly into the dust chamber, the air flow can simultaneously clean off the filter and empty the dust chamber. If the filter is embodied as cylindrical filter, for example, and if the dust chamber surrounds the cylindrical filter circumferentially, the air exiting from the filter can be introduced into the dust chamber in a systematic manner. For example folded filters can be used as filters. The cleaning off can be supported in an advantageous manner by means of slotted nozzles, which are arranged in the interior of the filter, whereby an effective air flow application of the filter is carried out and an effective application of the dust chamber can simultaneously take place as well, whereby a safe emptying of the dust chamber can be ensured.

If the air flow can be introduced into a cleaning nozzle, which is arranged in the interior of the filter, preferably a slotted nozzle and more preferably a rotating slotted nozzle, a further embodiment of the invention results. To clean off a permanent filter, an air flow, which is directed opposite to the suction operation, can be applied to the permanent filter. Air is thereby guided from the interior of the permanent filter in the direction through the filter. To support the cleaning off of the permanent filter, a cleaning nozzle can be used in an advantageous manner, which guides the air flow guided through the filter to different areas of the filter in a directed manner. A target-oriented introduction of a cleaning air flow can hereby improve the cleaning off of the permanent filter and can thus extend the service life thereof. In a preferred embodiment, a slotted nozzle can be used for the cleaning off and in an even more preferred embodiment, a rotating slotted nozzle can be arranged in the interior of the permanent filter, so that such an air flow can be directed onto the permanent filter, which provides for an improved cleaning off of the permanent filter. The form of the permanent filter is thereby not limited, but for example cylindrical as well as conical permanent filters can be used, which, in turn, then cooperate with a cylindrical or conical slotted nozzle.

In a further embodiment, the dust and/or dirt can be caught in the base station in a dust container, in particular a filter bag. The vacuum cleaner is docked against the base station or is inserted for example into the base station for example. The fan of the vacuum cleaner is used to empty the vacuum cleaner. A filter, for example a filter bag, into which the vacuum cleaner empties the dirt and/or dust, is arranged in the interior of the base station. With respect to the emptying of the vacuum cleaner, the base station can thus manage without electric or electronic additional components. Only in the event that the rechargeable batteries are to be charged in the vacuum cleaner by means of the base station, for example, additional electric and/or electronic components are necessary in the base station. With respect to the emptying of the vacuum cleaner, the base station forms a passive base station, which can manage without electronic and/or electric components, in particular without additional fan for producing the air flow required for emptying the vacuum cleaner.

If the air flow can be diverted at least by means of a valve in the vacuum cleaner, a further advantageous embodiment of the invention follows. If the base station is embodied as passive base station with respect to the emptying of the vacuum cleaner, the vacuum cleaner can have a valve, wherein the air flow produced by means of the suction fan can be diverted by means of the valve. If for example the dust chamber and/or the permanent filter is arranged in the immediately vicinity of the fan and is for example connected to the fan via an air guide channel, the air guide channel can be closed by means of a valve, so that a suction operation of the vacuum cleaner can be interrupted. If the air supply openings in the vacuum cleaner are embodied as valves, which can be controlled via the air flow, the air flow can be diverted by means of a valve in the air guide channel between dust chamber or filter, respectively, and fan, in such a way that a cleaning off and/or emptying of the vacuum cleaner can take place in combination with the base station. If the air guide channel is closed by means of the valve, a main flow direction of the air in the interior of the vacuum cleaner is interrupted, so that this can be referred to as a main valve. The air supply openings in the vacuum cleaner for returning the air into the vacuum cleaner then form valves.

If air flow supply channels can be released by placing the vacuum cleaner into the base station, so that a closed air flow circuit can be made possible through the vacuum cleaner and the base station, this results in a further embodiment of the invention. On the one hand, the air supply channels between vacuum cleaner and base station can be embodied as valves and/or openings, which can be controlled by the air flow, while, on the other hand, the air supply openings or outlet openings can also be embodied as mechanically acting flaps and/or valves. By placement or, in the case of a robotic vacuum cleaner, by moving the robotic vacuum cleaner against the base station, respectively, a connection is preferably established between the vacuum cleaner and the base station.

With respect to the emptying of the dust chamber and to form a closed air flow circuit, a connection between the vacuum cleaner and the base station is on principle at hand, when an outlet opening of the air flow cooperates with an air inlet opening of the base station and when at least one opening is present in the vacuum cleaner, by means of which the air flow can be returned from the base station into the vacuum cleaner. By connecting the vacuum cleaner to the base station, a sealing connection is established between vacuum cleaner and base station. Base station and/or vacuum cleaner can hereby have corresponding sealing means.

From a procedural aspect, the object of the invention is solved in that a method for emptying the dust chamber of a vacuum cleaner into a dust container of a base station is provided, wherein the vacuum cleaner has a suction opening for absorbing dirt and/or dust from a floor by means of a suction air flow, a fan, by means of which the suction air flow is produced, a dust chamber for holding dirt and/or dust, and an air outlet opening, such that air sucked in together with the dirt and/or dust can be discharged again, and the base station is connected to the vacuum cleaner in such a way that the dust chamber is emptied into the base station by means of an air flow, wherein the air flow used to empty the dust chamber is produced by the fan for producing the suction air flow and is blown into the dust chamber characterized in that the air flow exiting from the dust chamber is returned back into the vacuum cleaner through the base station.

Preferred further developments of the method according to the invention follow analogously to the above-described preferred further developments of the system according to the invention.

The invention will be explained in more detail below with reference to the enclosed drawings by means of preferred exemplary embodiments.

FIG. 1 shows a section through a hand-held vacuum cleaner in suction operation as well as a section through a portion of a corresponding base station according to a preferred embodiment of the invention in a schematic manner;

FIG. 1*a* shows an illustration of the vacuum cleaner according to FIG. 1, supplemented by an illustration of the air suction opening, the air outlet opening, and the openings comprising valves;

FIG. 2 shows an illustration according to FIG. 1 with a basic representation of the cleaning operation according to a preferred embodiment of the invention;

FIG. 2*a* shows an illustration of the vacuum cleaner according to FIG. 2, supplemented by an illustration of the air suction opening, the air outlet opening, and the openings comprising valves;

Figure 1:
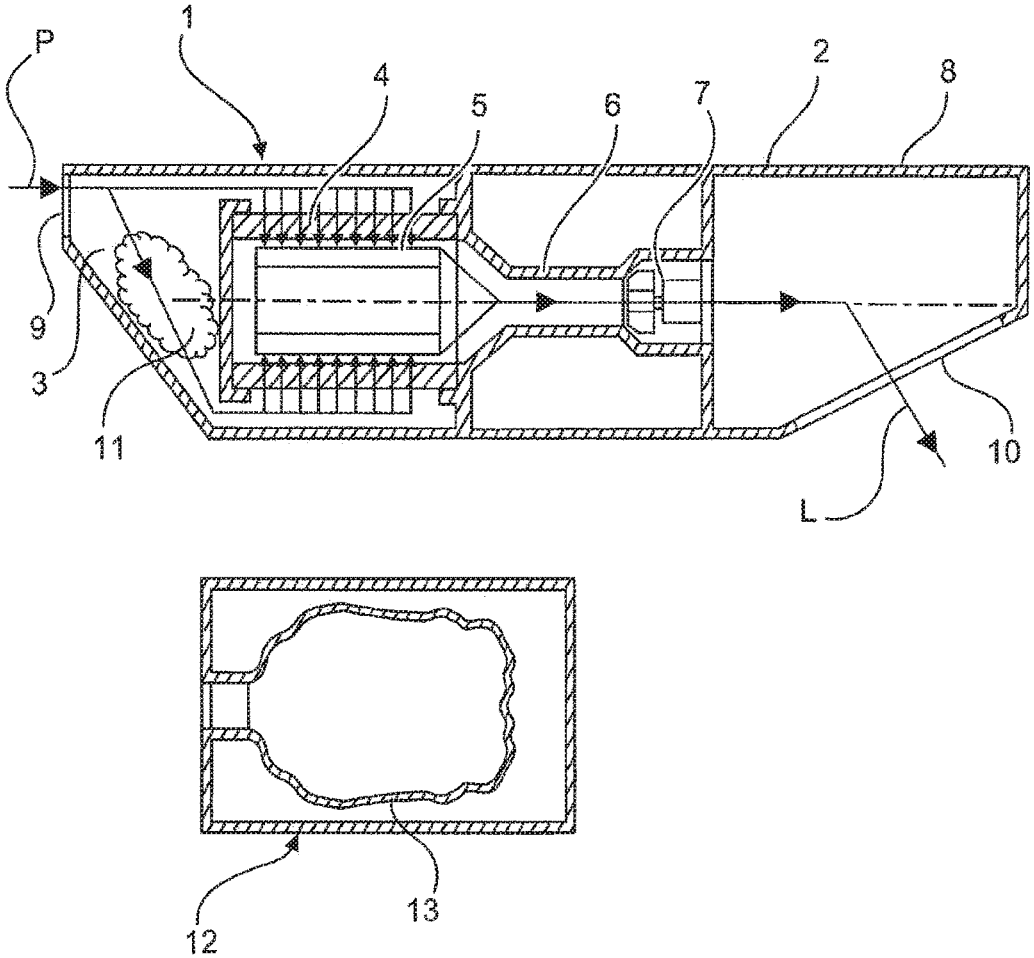

FIG. 1 reproduces a section through a vacuum cleaner 1 in the form of a hand-held vacuum cleaner in a schematic manner. The hand-held vacuum cleaner has a dust chamber 3, preferably a filter 4, more preferably a cleaning nozzle 5, which can be arranged in the filter 4 in a suitable manner, an air inlet channel 6, a fan 7, as well as a housing 8. A suction opening 9 and an air outlet opening 10 are provided in the housing. Only the components of the hand-held vacuum cleaner, which are necessary for explaining the suction operation, are illustrated. The air flow L through the hand-held vacuum cleaner 2 in the suction operation, is reproduced by means of the illustrated arrows P.

In suction operation, the fan 7 produces an air flow L in the direction of the arrows P. The air, which is permeated with dirt and/or dust, is thereby sucked in through the suction opening 9. The air flow L is guided through the dust chamber 3, preferably through the filter 4, which, more preferably is a permanent filter, and is cleaned from dirt and/or dust. The air flow L reaches further through the air guide channel 6 and along the fan 7 to the air outlet opening 10. In this suction operation, the dirt and/or dust 11, which is separated through the filter 4, if applicable, deposits in the dust chamber 3 and/or on an outer surface of the filter 4, which faces the dust chamber 3.

A filter 4, which does not need to be changed for a long period of time, but which is regenerated again by means of the cleaning operation described herein, is referred to as permanent filter. Cycles of between 10 and 100, if applicable also of up to 1,000 or more can result, in which the filter 4 is cleaned, without having to replace the filter 4.

A portion of a base station 12, namely the portion, which serves to hold the dust container 13, is also illustrated in FIG. 1. In the case at hand, the dust container 13 is embodied as filter bag. The function of the system of vacuum cleaner 1 and base station 12, and the air flow guide through the system will be explained in more detail below.

Figure 1A:
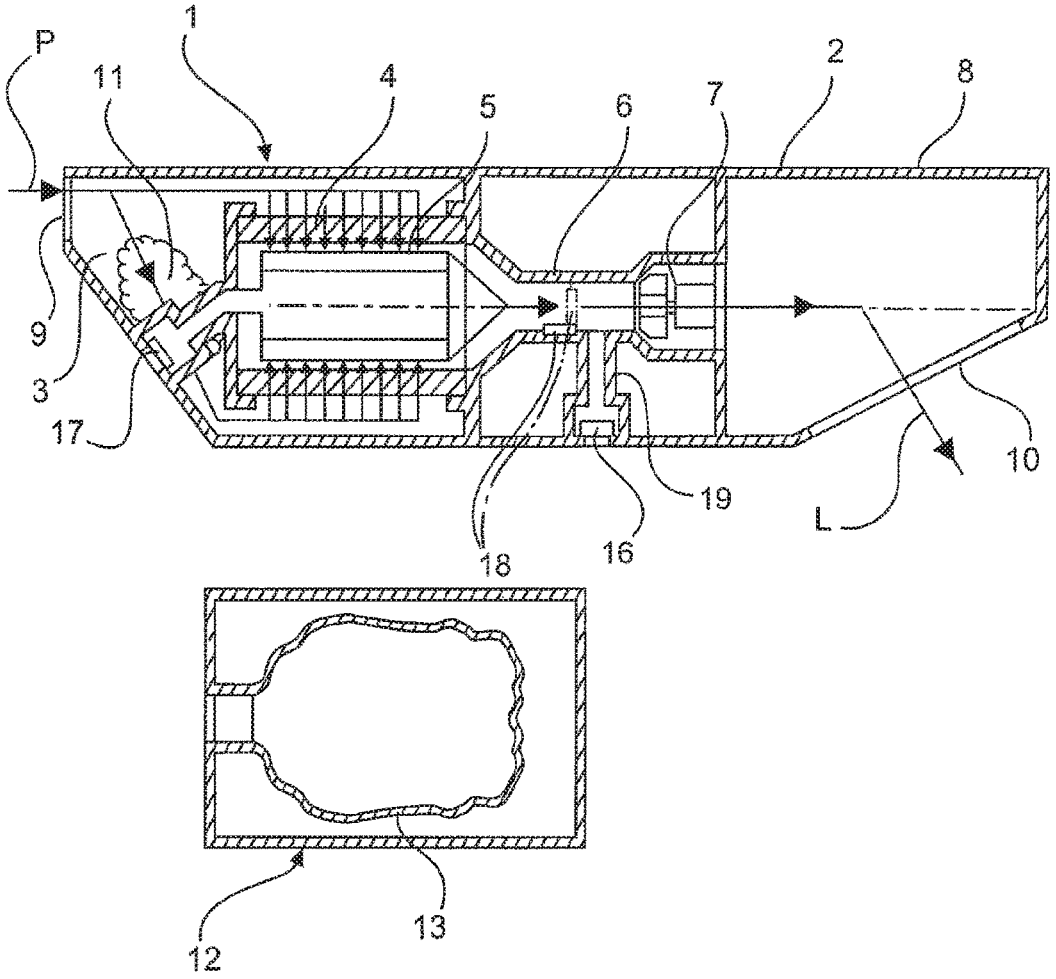

FIG. 1*a* shows the constellation of FIG. 1, but whereby the further openings of the vacuum cleaner are also illustrated here for the sake of clarity. In particular the openings, which are—preferably—provided with valves, for connecting to corresponding outlet openings of the base station, as will also be explained. The non-return valve 18, which may be present, has additionally been illustrated as well.

Figure 2:
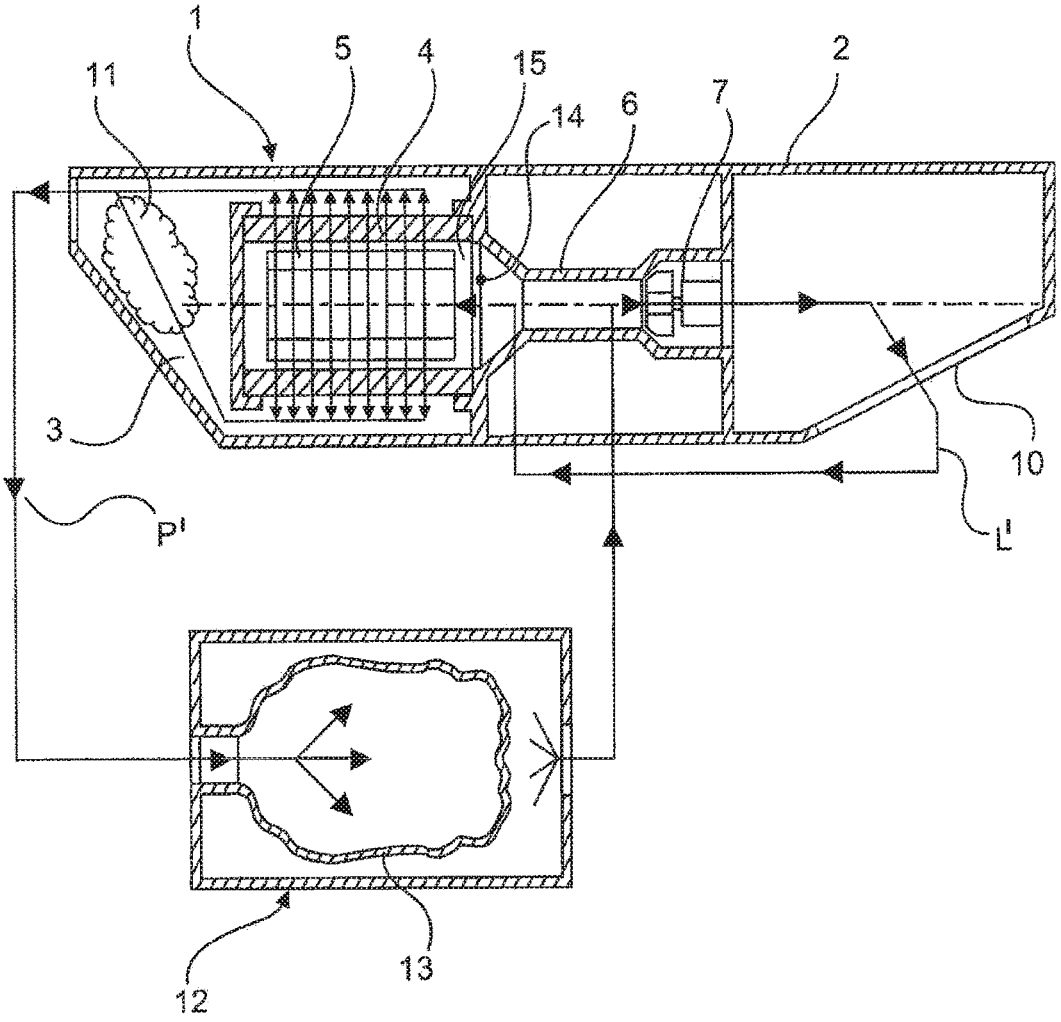

The basic course of the air flow L' is reproduced in FIG. 2 by means of the arrows P' in cleaning operation. The setup of the vacuum cleaner 1 corresponds to the setup of the hand-held vacuum cleaner 2 according to FIG. 1, whereby it is pointed out that the course of the air flow L' is illustrated only in a basic manner, without reproducing all necessary parts, for example for returning the air flow through the vacuum cleaner 1 as well as the base station 12. In the cleaning operation, dust and/or dirt 11 is emptied or removed, respectively, from the dust chamber 3. The fan 7 produces an air flow L' in the direction of the arrows P', so that the air flow L' flows out through the air outlet opening 10. The air exiting from the vacuum cleaner 2 is returned, wherein the returned air is returned into in the interior of the filter 15 on the fan-side end 14 of the filter.

The returned air flow L' can cooperate with the cleaning nozzle 5 and preferably sets the cleaning nozzle 5 into a motion in this case, more preferably into a rotational movement, so that the cleaning nozzle 5 transfers the air flow in the direction of the filter 4, which is preferably embodied as permanent filter. One or a plurality of opening 5, such as slots, can be present in the cleaning nozzle 5. The air flow L' reaches into the dust chamber 3 through the filter 4, whereby the filter 4 is cleaned off.

On the one hand, the air flow L' thus serves to clean off the filter 4 and can simultaneously serve to empty the dust chamber 3. After the air flow L' has exited the filter 4, the air flow L' holds the dirt and/or dust 11 and thus empties the dust chamber 3. The contaminated air is guided into the dust container 13 of the base station 12, in which the air flow L' is cleaned again. The air flow L' is subsequently returned back to the vacuum cleaner 2, and can be available for a cleaning off or emptying, respectively, again.

Figure 2A:
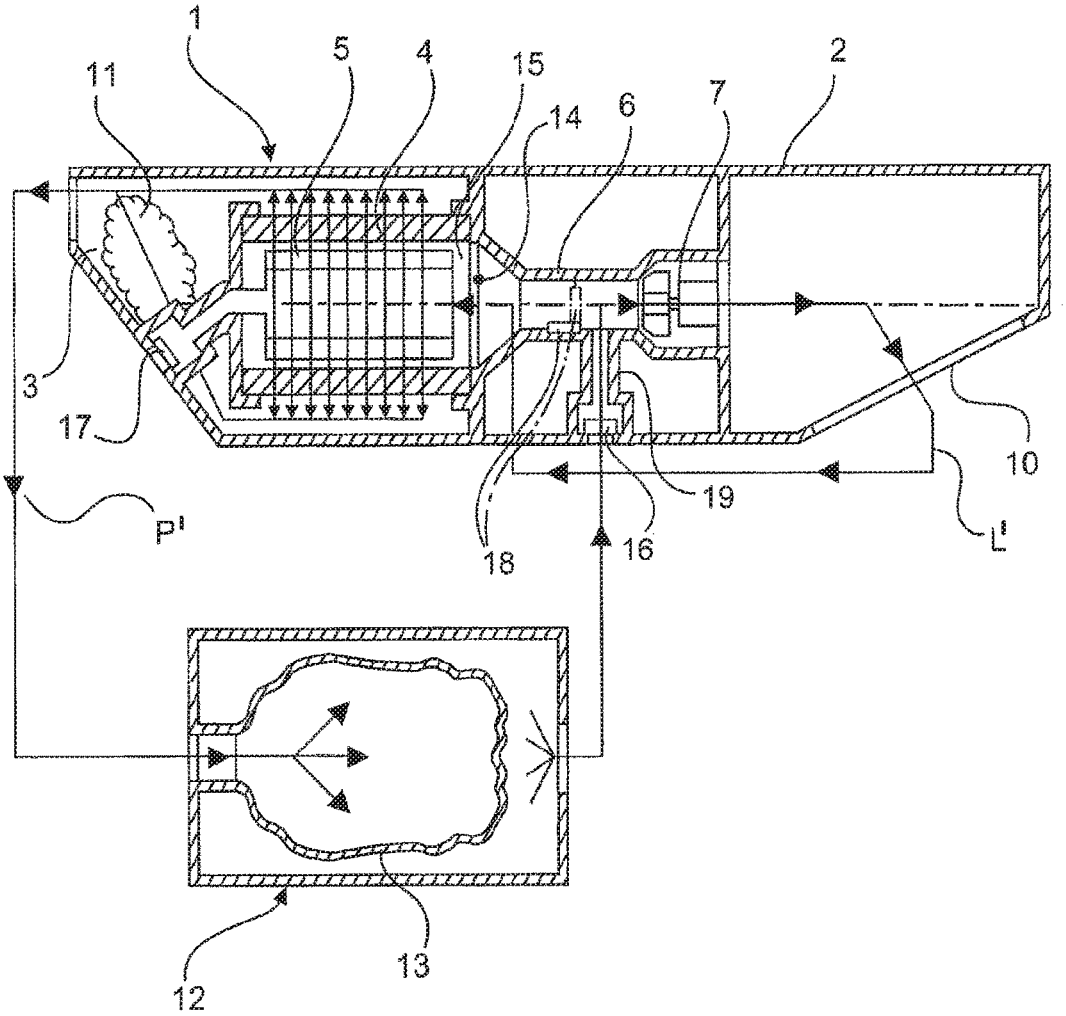

FIG. 2*a* shows an illustration according to FIG. 2, but wherein, with respect to the illustration of the vacuum cleaner, the latter is also provided with further openings, namely the openings, which are assigned to the outlet openings of the base station and which are provided with valves on the vacuum cleaner side. The non-return valve 18, which can be present, has been shown additionally as well.

Figure 3:
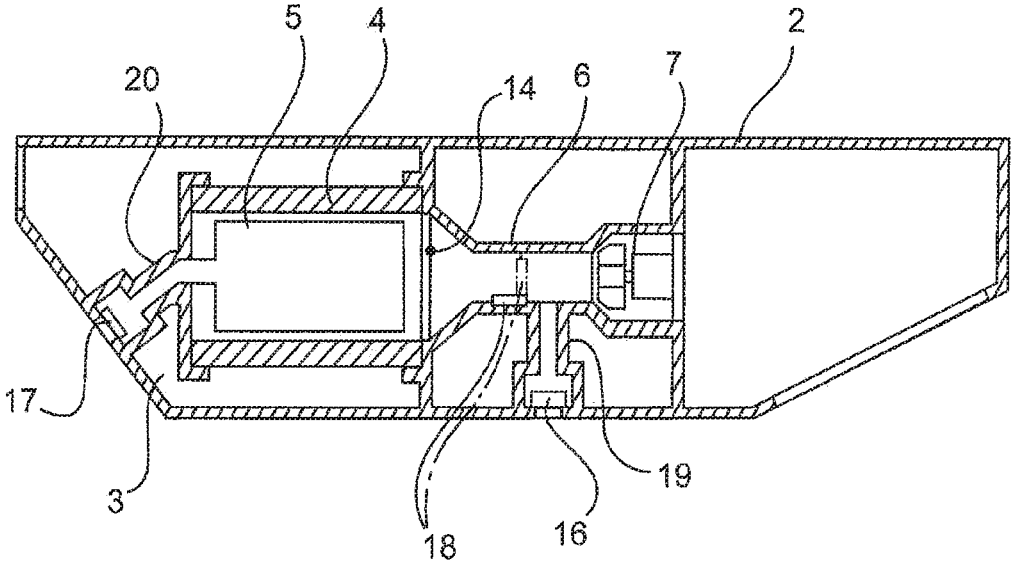
FIG. 3 shows a section through a hand-held vacuum cleaner according to a preferred embodiment of the invention in a schematic manner.

An alternative embodiment for returning the air flow L' is reproduced in FIG. 3. In addition to the components of the hand-held vacuum cleaner 2, which have already been explained, the and-held vacuum cleaner has valves 16, 17 as well as a non-return valve 18. The valves 16, 17, which form air inlet openings in the vacuum cleaner 2, are connected to the air guide channel 6 on the one hand via air guide channels 19 and 20 and to the interior of the filter 4 on the other hand, more preferably to the cleaning nozzle 5, which is located in this interior. The non-return valve 18 serves as valve and is not triggered in the illustrated normal operation, thus in suction operation. The triggered position is suggested in a dashed manner. As can be seen, the air for cleaning off the filter 4 is not supplied at the fan-side end 14, but, in the alternative, on the end opposite the fan 7 in the area of the dust chamber 3. The supply permeates the dust chamber 3 and leads directly into the interior of the filter 4.

Figure 4:
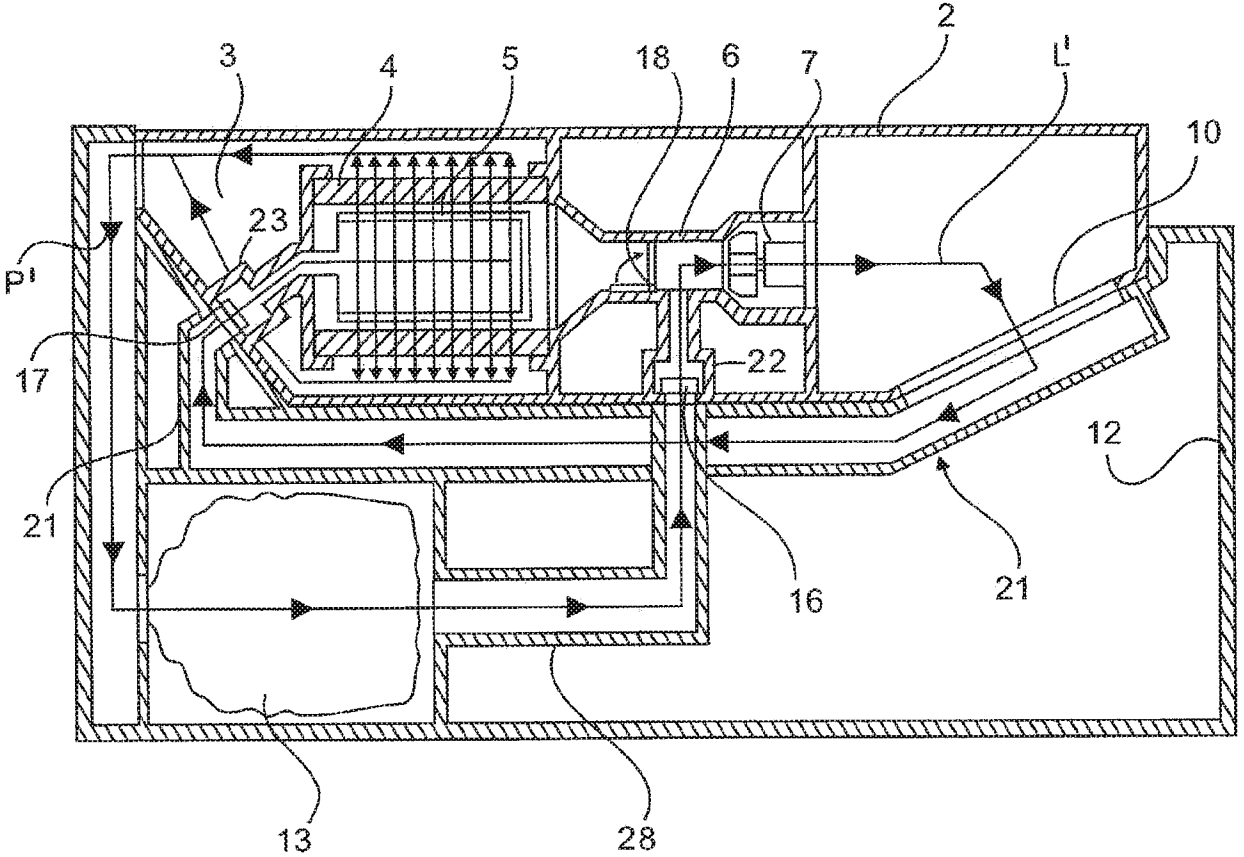
FIG. 4 shows the hand-held vacuum cleaner from FIG. 3 together with a base station comprising a closed air flow circuit, which is illustrated in principle, in cleaning operation in a schematic manner.

In FIG. 4, the base station 12 is reproduced with a vacuum cleaner 2, which is connected to the base station 12. The cleaning operation is illustrated, which can be seen by means of the arrows P' and the air flow circuit suggested by the arrows P'. A closed air flow circuit of the air flow L' through the vacuum cleaner 2 and through the base station 12 is shown thereby. The fan 7 produces a suction air flow, as also in suction operation, wherein the non-return valve 18 is closed, so that air is sucked in through the valve 16.

A movement of the non-return valve 18 into the closed position can be triggered by an underpressure pressure in a channel part 22, which leads from the valve 16 to the air guide channel 6 and/or an overpressure in the channel part 23, which leads from the valve 17 into the filter 4. A triggering as a result of the interconnection of the vacuum cleaner 1 with the base station 12 can take place as well, for instance by applying pressure to a button, which is embodied on the vacuum cleaner, by the base station 12 in the interconnected state according to FIG. 4.

Based on the fan 7, the air flow L' is guided through the air outlet opening 10 into the base station and enters into the vacuum cleaner 2 again through the valve 17. The cleaning nozzle 5 is driven by means of the air flow L' and the air is transferred in the direction of the filter 4. After cleaning off the filter 4, the air flow L' flows through the dust chamber 3 and empties dirt and dust 11 from the dust chamber 3. The air contaminated in this manner is guided into the dust container 13 of the base station 12 and is cleaned.

After the cleaning, the air flow L' is further transported through the return channel 21 in the base station 12 and is supplied to the vacuum cleaner 2 again through the valve 16. The base station 12 consists of passive components and can manage without electronic or electric components. By means of the connection of all air passages attained with the help of the valve circuit, a closed air circuit is created. The flow speed is increased by means of the rotating nozzle 5 in the filter interior 15 and the permanent filter 4 can be cleaned effectively.

Figure 4A:
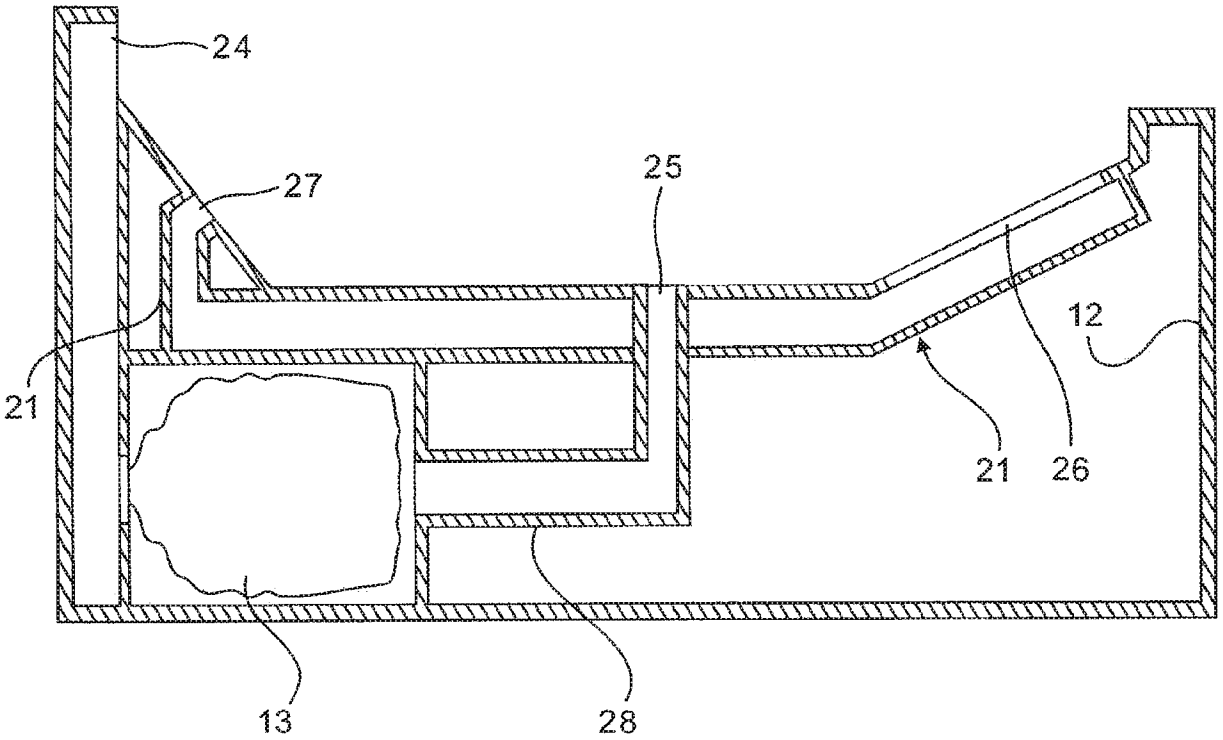
FIG. 4*a* shows an illustration of the base station alone.

It can in particular be gathered from FIG. 4*a*, which shows the base station in the state, in which it is not interconnected with the vacuum cleaner 1, that the base station has an outer surface in particular an outer surface A, which, in the interconnected state, faces the vacuum cleaner 1. Respective starting and end openings 24, 25 of the suction channel 28 and 26, 27 of the return channel 21 are present in this outer surface A. These openings are hereby adapted to the openings of the vacuum cleaner 1, which are assigned in the interconnected state and which adjoin directly. For instance, the size of the starting opening 26 of the return channel 21 is adapted to the air outlet opening 10 of the vacuum cleaner 1 and the beginning opening 24 of the suction channel 28 is adapted to the suction opening 9 of the vacuum cleaner 1.

The end openings 25, 27 are adapted to the corresponding openings of the channel parts 22, 23, which are in each case also embodied in an outer surface of the vacuum cleaner 1.

According to the valves 16, 17 in the vacuum cleaner 1, such valves can also be embodied in the alternative or additionally in the openings 25, 27 and, if applicable, also the openings 26 and 24 with regard to the valves 16, 17,

LIST OF REFERENCE NUMERALS vacuum cleaner 1
dust chamber 3
filter, permanent filter 4
cleaning nozzle 5
air guide channel 6
fan 7
housing 8
suction opening 9
air outlet opening 10
dirt and/or dust 11
base station 12
dust container 13
fan-side end 14
interior of the filter 15
valves 16, 17
non-return valve 18
air supply channels 19, 20
return channel 21
channel part 22, 23
beginning opening 24
end opening 25
beginning opening 26
end opening 27
suction channel 28
arrows P
air flow L

The invention claimed is:

1. A system comprising a vacuum cleaner (1) and a base station (12), wherein the vacuum cleaner (1) has a suction opening (9) for sucking up dirt and/or dust from a floor by means of a suction air flow, a fan (7) for producing the suction air flow, a dust chamber (3) for holding dirt and/or dust (11), and an air outlet opening (10) such that air sucked in together with the dirt and/or dust (11) can be discharged again, and the base station (12) can be connected to the vacuum cleaner (1) in such a way that the dust chamber (3) can be emptied into the base station (12) by means of an air flow (L), wherein the air flow (L) used to empty the dust chamber (3) can be produced by the fan (7) for producing the suction air flow and can be blown into the dust chamber (3), wherein the base station (12) has a return channel (21), through which the air flow (L) exiting the dust chamber (3) can be returned back into the vacuum cleaner (1), wherein the vacuum cleaner has a suction opening (5), which is provided upstream of the fan (7) in flow direction and which is in flow connection with the fan (7) and can be used for the cleaning operation and in addition to the suction opening (9).

2. A system comprising a vacuum cleaner (1) and a base station (12), wherein the vacuum cleaner (1) has a suction opening (9) for sucking up dirt and/or dust from a floor by means of a suction air flow, a fan (7) for producing the suction air flow, a dust chamber (3) for holding dirt and/or dust (11), and an air outlet opening (10) such that air sucked in together with the dirt and/or dust (11) can be discharged again, wherein a filter part is further arranged in the dust chamber, and the base station (12) can be connected to the vacuum cleaner (1) in such a way that the dust chamber (3) can be emptied into the base station (12) by means of an air flow (L), wherein the air flow (L) used to empty the dust chamber (3) can be produced by the fan (7) for producing the suction air flow and can be blown into the dust chamber (3), for the purpose of which a return channel (21), through which the air flow (L) exiting the dust chamber (3) can be returned back into the vacuum cleaner (1), is embodied in the return channel (21), wherein, in addition to the return channel (21), a suction channel (28) is embodied comprising a suction opening, which is separated from the return channel (21) and which can be connected to the suction opening (9), and blowing opening for connection to the blow-out opening (O1).

3. The system according to claim 1, wherein a filter (4) is arranged in the dust chamber (3).

4. The system according to claim 3, wherein the vacuum cleaner (1) can be connected to the base station (12) in such a way that the air flow (L) can be introduced into the interior (15) of the filter (4).

5. The system according to claim 3, wherein the air flow (L) can be introduced into the dust chamber (3) through the filter (4) and can thus serve to clean off the dust chamber (3).

6. The system according to claim 4, wherein the air flow (L) can be introduced into a cleaning nozzle (5), which is arranged in the interior (15) of the filter (4) and which is preferably embodied as slotted nozzle and more preferably as rotating slotted nozzle.

7. The system according to claim 1, wherein the vacuum cleaner (1) has a first valve (16), which can be controlled by means of the air flow (L), in order to transfer an air flow, which exits from the suction opening (9) and which is guided to the first valve (16) inside the base station (12), into the fan (7).

8. The system according to claim 3, wherein provision is made between the filter (4) and the fan (7) for a non-return valve (18), which, in the closed state, prevents that air can reach through the valve (16) into the filter (4).

9. The system according to claim 7, wherein the vacuum cleaner (1) has a second valve (17), which can be controlled by means of the air flow (L), in order to transfer an air flow, which exits from the one air outlet opening (10) and which is guided to the second valve (17) inside the base station (12), and to further guide it from there into the interior (15) of the filter (4).

10. A vacuum cleaner (1) comprising a suction opening (9) for sucking up dirt and/or dust from a floor by means of a suction air flow, a fan (7) for producing the suction air flow, a dust chamber (3) comprising a filter for holding dirt and/or dust (11), wherein the filter has a clean side and a dust side, and an air outlet opening, such that air sucked in together with the dirt and/or dust (11) can be discharged again, wherein, in addition to the suction opening or air outlet opening, two air suction openings, which can be opened, are embodied for a cleaning operation, in which dust collected in the vacuum cleaner is sucked up, one of which is switched to the suction side of the fan in the cleaning operation, to suck in air through this air suction opening, which can be opened, by means of the fan.

11. A base station for connection to a vacuum cleaner for emptying a dust chamber in the vacuum cleaner, wherein the base station has two channels, a return channel and a suction channel, which are separated from one another, wherein the return channel and the suction channel open with a respective beginning and end opening in an outer surface of the base station, for connection to the vacuum cleaner.

12. The base station according to claim 11, wherein suction or blowing air can be applied to the channels only via their beginning or end opening.

13. The base station according to claim 11, wherein the suction channel is embodied for pushing through suction air and wherein the return channel is embodied for pushing through compressed air.

14. A method for emptying the dust chamber (3) of a vacuum cleaner (1) into a dust container (13) of a base station (12) wherein the vacuum cleaner (1) has a suction opening (9) for absorbing dirt and/or dust from a floor by means of a suction air flow, a fan (7), by means of which the suction air flow is produced, a dust chamber (3) for holding dirt and/or dust (11), and an air outlet opening (10) such that air sucked in together with the dirt and/or dust (11) can be discharged again, and the base station (12) is connected to the vacuum cleaner (1) in such a way that the dust chamber (3) is emptied into the base station (12) by means of an air flow (L), wherein the air flow (L) used to empty the dust chamber (3) is produced by the fan (7) for producing the suction air flow and is blown into the dust chamber (3), and the air flow (L) exiting from the dust chamber (3) is returned through the base station (12) back into the vacuum cleaner (1), wherein compressed air acts on a filter in the dust chamber in the cleaning operation on the clean side and suction air on the dust side, wherein the compressed air and the suction air are produced by the same fan and in each case act on the filter element by means of the base station via different lines, which permeate the base station.

15. The method according to claim 14, wherein the dust chamber (3) is emptied through the suction opening (9).

16. The method according to claim 14, wherein the cleaning off of the filter (4) and the associated emptying of the dust chamber (3) takes place in the suction operation of the fan (7).

* * * * *